US006113371A

United States Patent [19]

Williams et al.

[11] Patent Number: 6,113,371

[45] Date of Patent: Sep. 5, 2000

[54] SCROLL-TYPE MACHINE WITH COMPACT OLDHAM COUPLING

[75] Inventors: John R. Williams; Joe T. Hill, both of Bristol, Va.; Gene M. Fields, Arkadelphia, Ark.

[73] Assignee: Scroll Technologies, Arkadelphia, Ark.

[21] Appl. No.: 09/166,485

[22] Filed: Oct. 5, 1998

[51] Int. Cl.[7] ..... F01C 1/02

[52] U.S. Cl. ..... 418/55.1; 418/55.3; 418/102

[58] Field of Search ..... 418/55.3; 464/102

[56] References Cited

U.S. PATENT DOCUMENTS

| | | | |
|---|---|---|---|
| 3,924,977 | 12/1975 | McCullough . | |
| 4,065,279 | 12/1977 | McCullough | 418/55 |
| 4,325,683 | 4/1982 | Miyazama | 418/55 |
| 4,655,696 | 4/1987 | Utter | 418/55 |
| 4,992,033 | 2/1991 | Caillat et al. . | |
| 5,551,851 | 9/1996 | Williams et al. | 418/55 |
| 5,588,820 | 12/1996 | Hill et al. . | |
| 5,593,295 | 1/1997 | Hill . | |

*Primary Examiner*—Thomas Denion
*Assistant Examiner*—Theresa Trien
*Attorney, Agent, or Firm*—Carlson, Gaskey & Olds

[57] ABSTRACT

A scroll compressor has a fixed scroll and an orbiting scroll nested with one another within a shell. The orbiting scroll has a base plate with a pair of opposed slots formed therein, and a spiral wrap extending axially from the base plate. The fixed scroll has a base plate and a spiral wrap extending axially from the fixed scroll base plate nested with the spiral wrap of the orbiting scroll. A pair of towers extends axially downwardly from the fixed scroll base plate, each tower having a slot formed therein, diametrically opposed from the slot formed in the other tower. An Oldham coupling has an annular ring with an irregular oval profile which closely follows the outermost radial surface of the spiral wraps as the scroll compressor operates. The Oldham coupling also has an asymmetric shape with respect to any vertical plane bisecting a central axis of the Oldham coupling. A pair of opposed keys extend axially from a first surface of the Oldham coupling slidingly engaging the slots in the towers. A second pair of opposed keys extend axially from a second surface of the Oldham coupling slidingly engaging the slots in the base plate of the orbiting scroll. The keys and slots interact as the orbiting scroll is driven by an eccentric pin on a crankshaft to create a non-rotating orbiting motion for the orbiting scroll.

19 Claims, 3 Drawing Sheets

SCROLL-TYPE MACHINE WITH COMPACT OLDHAM COUPLING

INTRODUCTION

The present invention is directed to a scroll-type machine, and, more particularly, to scroll-type machine having an improved compact Oldham coupling.

BACKGROUND

Scroll machines, such as scroll compressors using a fixed scroll and an orbiting scroll, are well known in the industry. Each of the scrolls of a scroll compressor has a spiral wrap extending axially from a base plate. The spiral wraps nest with one another to form pockets of varying volume. A fluid introduced into a low pressure area of the pockets is compressed by the cooperating movement of the spiral wraps, and discharged from a high pressure area proximate the center of the wraps. A motor drives a crankshaft which in turn drives the orbiting scroll along its circular orbital path via a slider block. A rotation prevention mechanism, such as an Oldham coupling, is used to prevent rotation of the orbiting scroll as it undergoes such orbital motion. Oldham couplings typically comprise a ring having a pair of upwardly projecting, diametrically opposed keys and a pair of downwardly projecting, diametrically opposed keys. In many applications the Oldham coupling is positioned between the orbiting scroll and a crankcase positioned within the scroll-type machine such that the pairs of keys mate with pairs of slots formed in the orbiting scroll and crankcase. In other applications, the Oldham coupling is positioned between the fixed and the orbiting scrolls, mating with corresponding pairs of slots formed in the fixed scroll and orbiting scroll.

U.S. Pat. No. 4,655,696 to Utter discloses an Oldham coupling positioned between a fixed scroll and an orbiting scroll, and which is stamped from sheet metal. The Oldham coupling of Utter has an annular ring with keys extending radially from the annular ring. The Oldham coupling of Utter is compact merely in an axial direction since the keys extend outwardly in a radial direction.

It is an object of the present invention to provide a scroll-type machine having a compact Oldham coupling which reduces or wholly overcomes some or all of the aforesaid difficulties inherent in prior known devices. Particular objects and advantages of the invention will be apparent to those skilled in the art, that is, those who are knowledgeable and experienced in this field of technology, in view of the following disclosure of the invention and detailed description of the preferred embodiments.

SUMMARY

The principles of the invention may be used to advantage to provide a scroll-type machine having an Oldham coupling sandwiched between a fixed scroll and an orbiting scroll to provide a radially compact compressor assembly.

In accordance with a first aspect, a scroll-type machine has a fixed scroll mounted within a housing and being fixed in position relative to the housing. The fixed scroll has a spiral wrap and a pair of slots in a first surface thereof. An orbiting scroll has a spiral wrap nested with the spiral wrap of the fixed scroll and a pair of slots in a second surface thereof generally facing the first surface of the fixed scroll. A motor drives the orbiting scroll via a crankshaft having an eccentric pin formed on one end thereof. The eccentric pin operably engages the orbiting scroll, with the crankshaft being rotatably driven by the motor. A substantially ring-shaped Oldham coupling is sandwiched axially between the fixed scroll and the orbiting scroll and is radially outbound of the outermost spiral wraps of the fixed and orbiting scrolls. A first pair of keys extends axially from a first surface of the Oldham coupling slidingly engaging the slots of the fixed scroll, and a second pair of keys extends axially from a second surface of the Oldham coupling slidingly engaging the slots of the orbiting scroll. The Oldham coupling has a non-uniform radial thickness.

In accordance with another aspect, a scroll-type machine has a fixed scroll mounted within a housing and fixed in position relative to the housing. The fixed scroll has a spiral wrap and a pair of slots in a first surface thereof. An orbiting scroll has a spiral wrap nested with the spiral wrap of the fixed scroll and a pair of slots in a first surface thereof generally facing the first surface of the fixed scroll. A motor drives the orbiting scroll via a crankshaft having an eccentric pin formed on one end thereof. The eccentric pin operably engages the orbiting scroll, with the crankshaft being rotatably driven by the motor. A substantially ring-shaped Oldham coupling is sandwiched axially between the fixed scroll and the orbiting scroll and is radially outbound of the outermost spiral wraps of the fixed and orbiting scrolls. The Oldham coupling has a central axis about which the Oldham coupling is asymmetric with respect to any vertical plane bisecting the central axis. A first pair of keys extends axially from a first surface of the Oldham coupling slidingly engaging the slots of the fixed scroll. A second pair of keys extends axially from a second surface of the Oldham coupling slidingly engaging the slots of the orbiting scroll.

From the foregoing disclosure, it will be readily apparent to those skilled in the art, that is, those who are knowledgeable or experienced in this area of technology, that the present invention provides a significant technological advance. Preferred embodiments of the present invention can provide scroll-type machines with Oldham couplings resulting in a more compact assembly. These and additional features and advantages of the invention disclosed here will be further understood from the following detailed disclosure of certain preferred embodiments.

BRIEF DESCRIPTION OF THE DRAWINGS

Certain preferred embodiments are described in detail below with reference to the appended drawings wherein.

Figure 1:
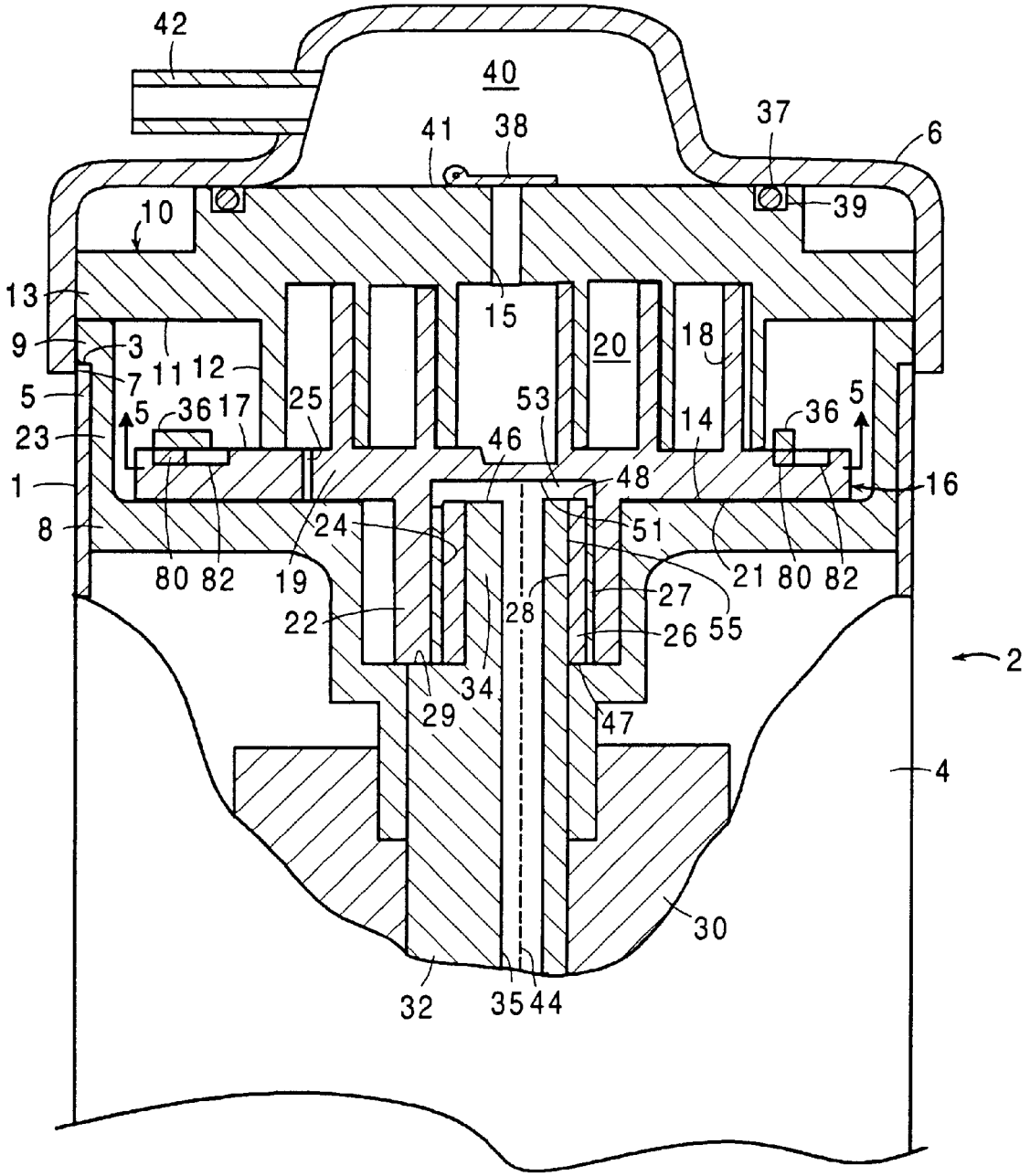
FIG. 1 is a schematic elevation view, shown partially broken away and partially in section of a scroll compressor of the present invention.

The figures referred to above are not drawn necessarily to scale and should be understood to present a representation of the invention, illustrative of the principles involved. Some features of the scroll compressor with compact Oldham coupling depicted in the drawings have been enlarged or distorted relative to others to facilitate explanation and understanding.

DETAILED DESCRIPTION OF CERTAIN PREFERRED EMBODIMENTS

Scroll type machines comprising fixed and orbiting scrolls are known in the industry for providing various functions. One such scroll type machine is a scroll compressor, used to compress a fluid such as refrigerant. Scroll machines in accordance with the invention will have configurations and components determined, in part, by the intended application and environment in which they are used. For purposes of illustration and description, the following discussion will focus on scroll compressors in accordance with certain preferred embodiments. Those skilled in the art will recognize, however, the ready application of the features and principles disclosed here to other scroll machines. Also, for convenience, the following discussion will use directional terms such as top or upward and bottom, lower or downward to refer to locations or directions for an upstanding scroll compressor design of the type illustrated in FIG. 1 of the appended drawings, unless otherwise clear from the context or from common usage regarding scroll machines. The non-orbiting, or fixed scroll 10 as shown in FIG. 1 does not orbit when the orbiting scroll 16 orbits. As is known, the fixed scroll is fixed against rotation within the housing number 6. Also, the illustrated embodiment is fixed against axial movement. There are other types of non-orbiting scrolls which do have some limited axial movement.

In a preferred embodiment, as seen in FIG. 1, scroll compressor 2 comprises a first housing member or center shell 4, preferably substantially cylindrical, having an opening defined by an upper end 5 of center shell 4, and a second housing member or top cap 6 closing off the opening and being secured to the upper end 5 of center shell 4. In the illustrated embodiment, an inner surface 7 of top cap 6 is secured to an outer surface 1 of center shell 4, preferably by spot welding. Crankcase 8, having a radially outward extending circumferential flange 9 which is supported by an upper end surface 3 at upper end 5 of center shell 4, is housed within center shell 4. In the illustrated embodiment, flange 9 extends circumferentially without interruption or gap around the perimeter of crankcase 8, but may in other preferred embodiments comprise several segments circumferentially spaced about the perimeter of crankcase 8. Fixed scroll 10, having spiral wrap 12 extending axially downwardly from a lower surface 11 of base plate 13, and a bore or discharge port 15 extending axially through a central portion of base plate 13, is supported by crankcase 8. Orbiting scroll 16, having spiral wrap 18 extending axially upwardly from an upper surface 17 of its base plate 19, is positioned between fixed scroll 10 and crankcase 8, with a lower surface 21 of base plate 19 positioned above upper surface 14 of crankcase 8. Wraps 12, 18 nest with one another to form discrete pockets 20 between the two scrolls for compressing volumes of gas as orbiting scroll 16 orbits. Hub 22 extends axially downwardly from base plate 19 of orbiting scroll 16, with axially extending central bore 24 formed therein. In other preferred embodiments central bore 24 may be formed at or in a lower surface of an orbiting scroll 16 having no axial hub. A passage 25 is preferably formed in orbiting scroll 16, putting lower surface 21 of base plate 19 of orbiting scroll 16 in fluid communication with an area of intermediate pressure of pockets 20, to provide an axial compliance force which supports orbiting scroll 16 and biases the tips of spiral wrap 18 against base plate 13 of fixed scroll 10.

Top cap 6 presses downwardly on fixed scroll 10 so that fixed scroll 10 is pinned between top cap 6 and center shell 4. Pinned, as used here, refers to a member, such as fixed scroll 10, being axially captured, i.e., fixed in place or immobilized, directly or indirectly, between two other members. Fixed scroll 10 may be in direct contact with top cap 6 and center shell 4 and pinned therebetween, or, as in the illustrated embodiment, be in direct contact with top cap 6 and crankcase 8 so that both fixed scroll 10 and crankcase 8 are pinned between top cap 6 and center shell 4. This eliminates the need in conventional scroll compressor assemblies of fastening fixed scroll 10 to crankcase 8, resulting, in preferred embodiments, in a boltless assembly. Boltless, when used here, refers to an assembly which fixes the fixed scroll and the crankcase to one another without the use of fasteners such as bolts to directly secure one to the other. Preferably in such boltless embodiments, the fixed scroll and crankcase also are boltlessly fixed axially relative the center shell, such as in the embodiment of FIG. 1.

In certain preferred embodiments, a resilient member or O-ring 37 forms a seal between fixed scroll 10 and top cap 6, creating muffler chamber 40. Preferably such muffler chamber 40 is formed in part by a raised central portion of top cap 6 and extends only across a portion of the interior of center shell 4. Annular recess 39 is formed in a discharge, top or upper surface 41 of fixed scroll 10 to receive O-ring 37. A discharge surface here means a substantially planar or curvo-planar exterior surface of the fixed scroll through which discharge port 15 passes. O-ring 37 sealingly engages top cap 6 and discharge surface 41 of fixed scroll 10, and can compensate for any misalignment of these members with respect to one another.

In preferred embodiments, a raised tower or riser 23 is formed on crankcase 8, radially outward of upper surface 14, and supports lower surface 11 of fixed scroll 10. The term raised tower or riser, as used here, refers to a member such as a projection extending axially upwardly, providing a supporting surface for the fixed scroll. Such raised tower or riser can extend circumferentially uninterrupted all the way around the perimeter of the crankcase. Alternatively, two or more risers can be circumferentially spaced around the perimeter of the crankcase. Riser 23 preferably extends axially above base plate 19 of orbiting scroll 16, i.e. above upper surface 17 of base plate 19, and more preferably extends more than half the height of spiral wrap 18 of orbiting scroll 16, e.g. substantially to the height of the tips of spiral wrap 18. Flange 9, as discussed above, extends radially outwardly from riser 23, preferably at the top of riser 23 as in the illustrated embodiment. Riser 23 and flange 9 in certain preferred embodiments are unitary with crankcase 8 providing excellent manufacturing and assembly efficiency. Riser 23 may, in certain preferred embodiments, be comprised of a plurality of axially extending members, each of which extends circumferentially only partially along the outer peripheral edge of crankcase 8.

Figure 2:
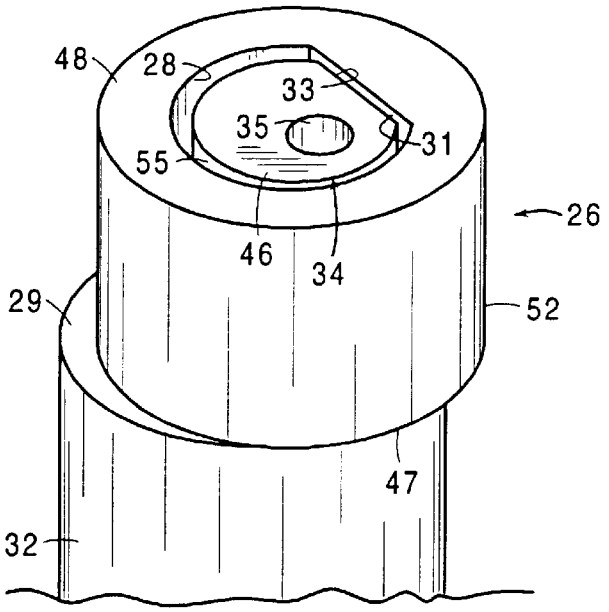
FIG. 2 is a schematic perspective view, shown partially broken away, of the slider block, crankshaft, and eccentric pin of the scroll compressor of FIG. 1.

Slider block 26, best seen in FIG. 2, having pin bore 28 extending therethrough, is received by central bore 24 and rests on shoulder 29 at the top end of crankshaft 32. In certain preferred embodiments, bushing 27 is positioned in central bore 24 concentrically around slider block 26. Motor 30 is housed within center shell 4 and rotatably drives axially extending crankshaft 32. Eccentric pin 34 extends axially from top end 29 of crankshaft 32, having flat drive surface 33 formed thereon and is received by pin bore 28, as seen in FIG. 2. Top surface 46 of eccentric pin 34 is preferably substantially flush with top surface 48 of slider block 26. Alternatively, eccentric pin 34 can have an axial height less than that of slider block 26 above shoulder 29. Lubricant passageway 35 extends axially through crankshaft 32 and eccentric pin 34 for delivery of a lubricant such as oil from a reservoir (not shown) located in a lower portion of compressor 2.

In operation, motor 30 rotatably drives crankshaft 32 and thus, eccentric pin 34. Flat drive surface 33 on eccentric pin 34 engages flat driven surface 31 to rotate and orbit slider block 26, shown in FIG. 2, thereby driving orbiting scroll 16 via slider block 26 and bushing 27. A rotation prevention mechanism, such as Oldham coupling 36, is positioned, or sandwiched, between fixed scroll 10 and orbiting scroll 16, to prevent rotation of orbiting scroll 16 as it undergoes such orbital motion.

Figure 3:
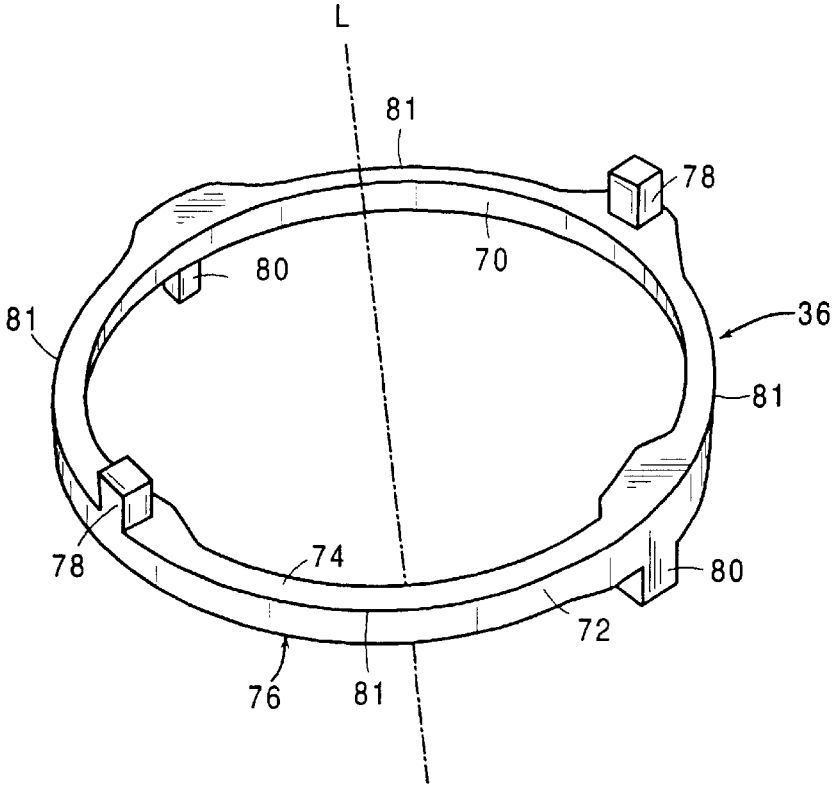
FIG. 3 is a schematic perspective view of the Oldham coupling of the scroll compressor of FIG. 1.

Oldham coupling 36 is shown in more detail in FIG. 3. Oldham coupling 36 comprises a substantially annular ring having a radially inner surface 70, a radially outer surface 72, an axially upper surface 74, and an axially lower surface 76. Radially inner surface 70 defines an irregular oval profile. A first pair of keys 78 extend axially upwardly from upper surface 74. A second pair of keys 80 extend axially downwardly from lower surface 76. In certain preferred embodiments, each key of the pairs of keys 78, 80 is diametrically opposed to the other key of its pair. Oldham coupling 36 has a central axis L which is substantially perpendicular, or normal, to the major plane of the annular ring of Oldham coupling 36. Central axis, when used here, generally refers to a line which intersects with a point located at the intersection of a first line between the pair of keys 78 and a second line between the pair of keys 80 (not shown). Central axis L is not necessarily the center of orbit, nor are there in all embodiments necessarily four equal sized quadrants defined by these two lines. Axial, when used here with reference to Oldham coupling 36, refers to a direction substantially parallel to central axis L and substantially perpendicular to the major plane of the annular ring of Oldham coupling 36. Arc segments 81 of the annular ring extend between and interconnect each adjacent pair of keys 78, 80. Keys 78 are, in certain preferred embodiments, offset 90° from keys 80. Keys 78, 80 are preferably unitary, that is, of one-piece construction, with the annular ring of Oldham coupling 36. Keys 80 slidingly engage a pair of slots 82 formed in base plate 19 of orbiting scroll 16, as shown in FIG. 1. Slots 82 are preferably diametrically opposed and extend radially in base plate 19.

Key, as used here, refers to a member, such as a projection or protrusion, which extends axially from the Oldham coupling and slidingly engages with a slot formed in another member, such as an orbiting scroll. The sliding engagement of the upper and lower keys and slots allows orbital motion and prevents angular rotation of the orbiting scroll. In certain preferred embodiments, the keys have a rectangular shaped cross-section in a plane normal to axis L.

Figure 4:
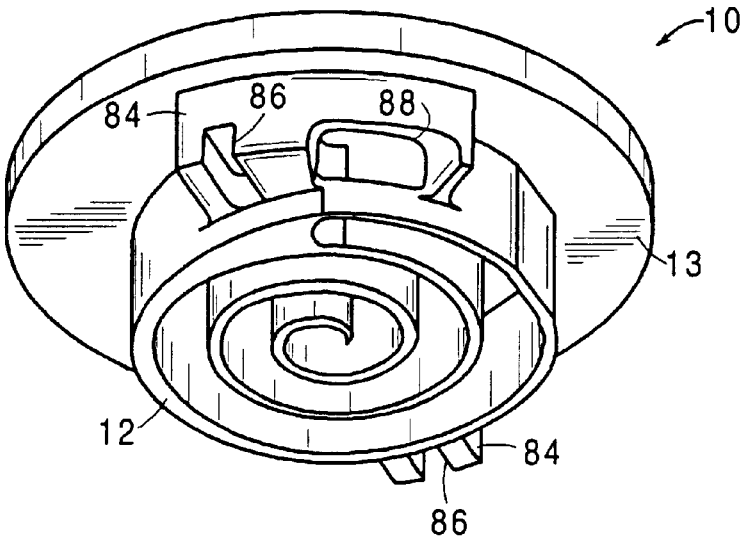
FIG. 4 is a schematic perspective view of a preferred embodiment of the fixed scroll of the scroll compressor of FIG. 1.

A pair of towers 84, shown in FIG. 4, extend axially downwardly from base plate 13 of fixed scroll 10. Each tower 84 has a slot 86 formed therein, preferably diametrically opposed to the slot 86 formed in the other tower 84 and extending radially with respect to fixed scroll 10. Slots 86 slidingly engage upwardly projecting keys 78 of Oldham coupling 36. Towers 84 are provided on base plate 13 since, due to the separation between the base plates 13, 19, seen more clearly in FIG. 1, the keys of Oldham coupling 36 could not reach both pairs of slots if the slots were formed in the main planar portion of the base plates of both fixed and orbiting scrolls 10, 16. The term tower, as used here, refers to a member extending axially from a base plate, forming slots which receive axially projecting keys of the Oldham coupling. It is to be appreciated that in certain preferred embodiments, a pair of upwardly projecting towers having slots may be formed on base plate 19 of orbiting scroll 16 while a pair of slots may be formed also or instead in base plate 13 of fixed scroll 10, such that the keys of Oldham coupling 36 can reach and slidingly engage both sets of slots. It is preferred, however, to form the towers only on fixed scroll 10 in order to reduce the weight of orbiting scroll 16.

References here, and in the claims, to a lower surface of the fixed scroll includes the illustrated embodiment where the towers are extensions of the lower surface of the base plate of the fixed scroll. The axially lower surface of the towers, in certain preferred embodiments, is, therefore, treated as part of the lower surface of the fixed scroll.

Keys 78, 80 of Oldham coupling 36 slidingly engage slots 82, 86 of orbiting scroll 16 and fixed scroll 10, respectively, to facilitate the orbiting motion and prevent angular rotation of orbiting scroll 16. In the preferred embodiment illustrated, inlet port 88 is formed in a tower 84 to pass fluid to the low pressure areas of pockets 20.

Figure 5:
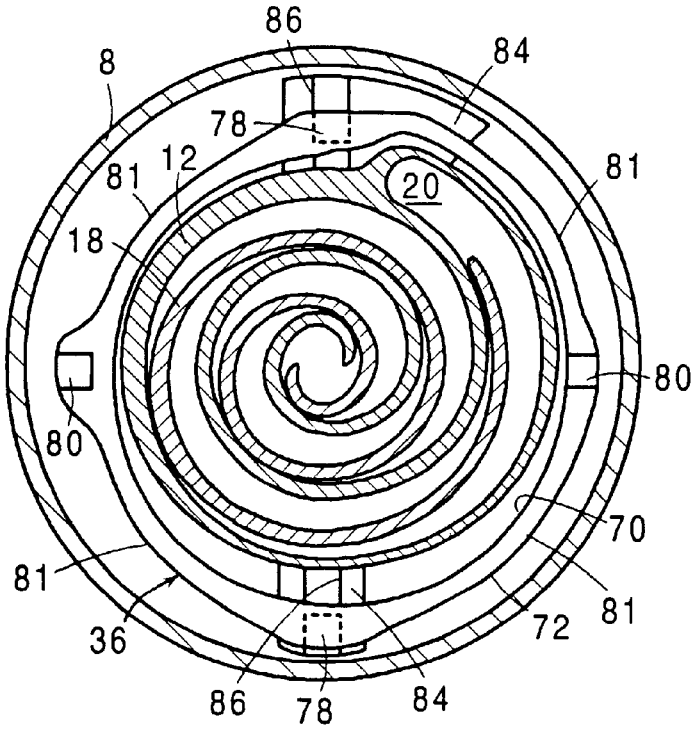
FIG. 5. is a schematic section view, shown partially broken away, of the scroll compressor taken along line 5—5 of FIG. 1.

Oldham coupling 36, as seen in FIG. 3, has a non-uniform thickness, that is, in its axial dimension. Specifically, keys 78 and 80 extend axially from upper surface 74 and lower surface 76, respectively, such that Oldham coupling 36 has a greater thickness, or axial dimension, in at least the areas of keys 78 and 80 than in the areas of arc segments 81. In addition, inner radial surface 70 of Oldham coupling 36 has a profile which is irregular, i.e. an irregular oval, or non-uniform (seen more clearly in FIG. 5 where a portion of orbiting scroll 16 is broken away), and closely follows the profile of spiral wrap 12 of fixed scroll 10 as orbiting scroll 16 orbits. In the preferred embodiment shown, various points of different portions of inner surface 70 sit closely against outermost radial portions of spiral wrap 12. More importantly, there is no portion of inner surface 70 which does not at some point in a full orbit sit in close proximity to a corresponding portion of the outermost radial portions of fixed scroll 10 and orbiting scroll 16. Outer surface 72 has an irregular, or non-uniform profile as well, substantially matching that of inner surface 70. Portions of outer surface 72 do not match the profile of inner surface 70, that is, the radial dimension of Oldham coupling 36 along arc segments 81 varies and is irregular, resulting in a slightly thicker ring along these portions as measured in a radial direction, in order to accommodate keys 78 and 80. Oldham coupling 36, therefore, has an asymmetric profile, that is, it is asymmetric with respect to any vertical plane which bisects central axis L, and is contoured to wrap around spiral wrap 12. By conforming the shape of Oldham coupling 36 to closely follow that of the outermost radial surface of spiral wrap 12 as orbiting scroll 16 orbits, the overall radial dimension of Oldham coupling 36 can advantageously be reduced, making it more compact in a radial direction, allowing for a smaller diameter scroll compressor housing. This will also advantageously allow Oldham coupling 36 to be fit inside the available space between spiral wrap 12 and crankcase 8.

A fluid, typically refrigerant, is introduced into a low pressure area of pockets 20 via inlet port 88, typically proximate an outer edge of spiral wraps 12, 18. As orbiting scroll 16 orbits, pockets 20 spirally inward with progressively decreasing volume, thus compressing the fluid in pockets 20. The compressed fluid is discharged from a high pressure area of pockets 20, typically in a central portion thereof, via valve 38, formed on a top surface of fixed scroll 10, into chamber 40 formed by top shell 6, shown in FIG. 1. The compressed fluid is then discharged from chamber 40 via outlet 42, which extends through an outer surface of top shell 6.

Oil, shown by dashed lines 44, is fed upwardly through passageway 35 from a reservoir (not shown) as crankshaft 32 rotates. Oil 44 reaches top surface 46 of eccentric pin 34 and is thrown outwardly by centrifugal forces. Oil 44 travels across top surfaces 46, 48 of eccentric pin 34 and slider block 26, respectively, and then downwardly on outer surface 52 of slider block 26, the surface of bushing 27, and the surface 55 of eccentric pin 34. Oil 44 then drains back to the reservoir, completing the lubrication cycle of these bearing surfaces. In certain preferred embodiments, an axial nub (not shown) extends upwardly from the top surface of the slider block to maintain a gap above the slider block which allows the oil to flow freely across the entire surface of the slider block.

In light of the foregoing disclosure of the invention and description of certain preferred embodiments, those who are skilled in this area of technology will readily understand that various modifications and adaptations can be made without departing from the true scope and spirit of the invention. All such modifications and adaptations are intended to be covered by the following claims.

We claim:

1. A scroll-type machine comprising, in combination:

a non-orbiting scroll mounted within a housing and being rotationally fixed in position relative to the housing, having a spiral wrap and a pair of slots in a first surface thereof;

an orbiting scroll having a spiral wrap nested with the spiral wrap of the fixed scroll and a pair of slots in a first surface thereof generally facing the first surface of the non-orbiting scroll;

a motor for driving the orbiting scroll;

a crankshaft having an eccentric pin formed on one end thereof, the eccentric pin operably engageable with the orbiting scroll, the crankshaft being rotatably driven by the motor; and a substantially ring-shaped Oldham coupling sandwiched axially between the non-orbiting scroll and the orbiting scroll and radially outbound of the spiral wraps of the fixed and orbiting scrolls, a first pair of keys extending axially from a first surface thereof slidingly engaging the slots of the non-orbiting scroll, and a second pair of keys extending axially from a second surface thereof slidingly engaging the slots of the orbiting scroll, wherein an inner radial surface of the Oldham coupling forms an irregular oval.

2. The scroll-type machine according to claim 1, wherein the inner radial surface of the Oldham coupling closely follows the outermost radial surface of the spiral wraps of the fixed and orbiting scrolls during operation of the scroll-type machine.

3. The scroll-type machine according to claim 1, further comprising a pair of axially extending towers formed on at least one of the non-orbiting and orbiting scrolls, the slots of the one of the non-orbiting and orbiting scrolls being formed in the towers to slidingly receive a corresponding key.

4. The scroll-type machine according to claim 3, wherein the towers are formed on the non-orbiting scroll, extending axially toward the orbiting scroll.

5. The scroll-type machine according to claim 1, wherein the orbiting scroll has a base plate, the orbiting scroll slots being formed in the base plate and extending radially therein.

6. The scroll-type machine according to claim 1, wherein the first pair of keys, the second pair of keys, and the Oldham coupling are of one-piece construction.

7. The scroll-type machine according to claim 1, wherein the slots of the non-orbiting scroll extend radially in the non-orbiting scroll and the slots of the orbiting scroll extend radially in the orbiting scroll.

8. The scroll-type machine according to claim 1, wherein the slots in the non-orbiting scroll are diametrically opposed to one another, the slots in the orbiting scroll are diametrically opposed to one another, the first pair of keys are diametrically opposed to one another, and the second pair of keys are diametrically opposed to one another.

9. The scroll-type machine according to claim 1, further comprising a plurality of arc segments interconnecting adjacent pairs of keys, each arc segment having an irregular radial dimension and an inner surface that closely follows the outermost radial surface of the spiral wraps of the fixed and orbiting scrolls during operation of the scroll-type machine.

10. A scroll-type machine comprising, in combination:

a non-orbiting scroll mounted within a housing and being rotationally fixed in position relative to the housing, having a spiral wrap and a pair of slots in a first surface thereof;

an orbiting scroll having a spiral wrap nested with the spiral wrap of the non-orbiting scroll and a pair of slots in a first surface thereof generally facing the first surface of the non-orbiting scroll;

a motor for driving the orbiting scroll;

a crankshaft having an eccentric pin formed on one end thereof, the eccentric pin operably engageable with the orbiting scroll, the crankshaft being rotatably driven by the motor; and a substantially ring-shaped Oldham coupling sandwiched axially between the non-orbiting scroll and the orbiting scroll and radially outbound of the spiral wraps of the fixed and orbiting scrolls, having a central axis about which the Oldham coupling is asymmetric with respect to any vertical plane bisecting the central axis, a first pair of keys extending axially from a first surface thereof slidingly engaging the slots of the fixed scroll, and a second pair of keys extending axially from a second surface thereof slidingly engaging the slots of the orbiting scroll.

11. The scroll-type machine according to claim 10, wherein the spiral wrap of the non-orbiting scroll and the spiral wrap of the orbiting scroll each have substantially involute profiles, and an inner radial surface of the Oldham coupling closely follows the outermost radial surface of the spiral wraps of the non-orbiting and orbiting scrolls during operation of the scroll-type machine.

12. The scroll-type machine according to claim 10, further comprising a pair of axially extending towers formed on at least one of the non-orbiting and orbiting scrolls, the slots of the one of the fixed and orbiting scrolls being formed in the towers to slidingly receive a corresponding key.

13. The scroll-type machine according to claim 12, wherein the towers are formed on the non-orbiting scroll, extending axially toward the orbiting scroll.

14. The scroll-type machine according to claim 10, wherein the orbiting scroll has a base plate, the orbiting scroll slots being formed in the base plate and extending radially therein.

15. The scroll-type machine according to claim 10, wherein the slots of the fixed scroll extend radially in the non-orbiting scroll and the slots of the orbiting scroll extend radially in the orbiting scroll.

16. The scroll-type machine according to claim 10, wherein the slots in the non-orbiting scroll are diametrically opposed to one another, the slots in the orbiting scroll are diametrically opposed to one another, the first pair of keys are diametrically opposed to one another, and the second pair of keys are diametrically opposed to one another.

17. The scroll-type machine according to claim 10, wherein the first pair of keys are offset 90° from the second pair of keys.

18. A scroll-type machine comprising, in combination:

a non-orbiting scroll mounted within a housing and being rotationally in position relative to the housing, having a spiral wrap with a substantially involute profile and a pair of towers extending axially from a lower surface thereof, a radially extending slot being formed in each tower diametrically opposed from the slot in the other of the towers;

an orbiting scroll having a spiral wrap with a substantially involute profile nested with the spiral wrap of the fixed scroll and a pair of diametrically opposed radially extending slots in an upper surface thereof generally facing the lower surface of the fixed scroll;

a motor for driving the orbiting scroll;

a crankshaft having an eccentric pin formed on one end thereof, the eccentric pin operably engagable with the orbiting scroll, the crankshaft being rotatably driven by the motor; and a substantially ring-shaped Oldham coupling positioned axially between the fixed scroll and the orbiting scroll, an inner surface of the Oldham coupling radially outbound of and closely following the profile of the outermost spiral wraps of the fixed scroll as the scroll-type machine operates, the Oldham coupling having a central axis about which the Oldham coupling is asymmetric with respect to any vertical plane bisecting the central axis, a first pair of diametrically opposed keys extending axially from a top surface thereof slidingly engaging the slots of the fixed scroll, and a second pair of diametrically opposed keys extending axially from a bottom surface thereof slidingly engaging the slots of the orbiting scroll.

19. The scroll-type machine according to claim 1, wherein said Oldham coupling has a varying thickness to provide said irregular oval.

* * * * *